United States Patent [19]

Jakob

[11] 4,037,520

[45] July 26, 1977

[54] FLUID MOTOR APPARATUS

[76] Inventor: Herbert Edward Jakob, 8 Pritchard Lane, Taylors, S.C. 29687

[21] Appl. No.: 608,883

[22] Filed: Aug. 29, 1975

[51] Int. Cl.[2] ..... F01L 15/12; F01L 25/04; F01L 21/02; F01B 7/18

[52] U.S. Cl. ..... 91/224; 91/225; 91/227; 91/235; 91/289

[58] Field of Search ..... 91/224, 225, 227, 235, 91/280, 317, 299

[56] References Cited

U.S. PATENT DOCUMENTS

| | | | |
|---|---|---|---|
| 181,386 | 8/1876 | Winchester | 91/224 |
| 931,449 | 8/1909 | Mauss | 91/224 |
| 1,031,340 | 7/1912 | Howard | 91/224 |
| 2,932,175 | 4/1960 | May | 91/317 |
| 3,468,222 | 9/1969 | Cordes et al. | 91/280 |
| 3,620,126 | 11/1971 | Fuhrimann | 91/280 |
| 3,969,984 | 7/1976 | Bouyoucos | 91/321 |

*Primary Examiner*—Paul E. Maslousky
*Attorney, Agent, or Firm*—Dunlap, Codding & McCarthy

[57] ABSTRACT

An improved fluid motor having only two moving components, a reciprocatable piston and a fluid actuated valve spool. The piston is supported for linear movement in a piston support bore of a barrel assembly, and is moved in alternating directions by the operation of selected porting of a pressure fluid selectively admitted against differential piston pressure faces. The valve spool is disposed in an inner bore in the piston and is alternately driven in opposing directions by automatically controlled and selective application of fluid pressure. The fluid motor experiences no mechanical impact between the valve spool and the piston.

8 Claims, 4 Drawing Figures

FLUID MOTOR APPARATUS

BACKGROUND OF THE INVENTION

1. Field of the Invention

The present invention relates generally to the field of motors, and more particularly, but not by way of limitation, to the field of fluid pressure operated linear reciprocating motors.

2. Description of the Prior Art

Bias spool valves have long been used to operate fluid pressure operated linear reciprocating motors. Such motors usually have a piston that is reciprocated by the application of constant pressure against a first pressure face at one end of the piston and a variable fluid pressure against a second pressure face at the other end of the piston, the first and second pressure faces being of different areas so as to present a differential pressure force thereagainst. This is sometimes designated a differential type piston motor. In order to move the piston, of course, fluid pressure must be varied against one of the pressure faces, and this is usually the larger of the pressure faces. Early prior art devices selectively manipulated the fluid pressure by external valving means. However, with the invention of the bias spool valve, a device was available for an internally disposed, fluid actuated valving mechanism for varying the pressure against the larger pressure face. Various designs have been proposed for porting fluid to the piston, the bias valve spool serving to selectively port the fluid pressure to the piston pressure faces while the spool itself being selectively positioned by the fluid pressure action thereupon. As its name implies, the valve spool also is manipulated by varying the pressure against differential pressure faces disposed thereon.

As the valve spool moves in a typical fluid motor, it serves to open and close fluid ports, thereby selectively routing the pressure fluid in a manner that varies the pressure against the piston pressure faces. In some designs, the spool or the piston physically moves a member in relation to the fluid passageways, and in other designs the spool selectively blocks the fluid passageways.

Due to the cycling rate required in most fluid motor applications, any physical contact or impact between moving components is undesirable, as this leads to deterioration and subsequent reduction of unit efficiency and life expectation. In prior art devices, it has usually been necessary to limit the cyling rate below the unit's potential rate in order to strike a working balance between power output and unit deterioration. Even so, such prior art units offer low operating efficiencies of power transfer usually in the order of 20% or less.

Prior art units, along with their low efficiencies, have been known to create a great deal of objectionable noise. This is due to the high rate of fluid through-put required to generate a given power output, as well as the noise generated due to mechanical impact of moving components.

SUMMARY OF INVENTION

One of the objects of the present invention is to provide an improved fluid actuated motor apparatus that comprises a minimum number of moving components.

Another object of the present invention is to provide an improved fluid motor apparatus that experiences no impact between its moving components.

Another object of the present invention is to provide an improved fluid motor apparatus that is capable of very high cycling rates.

Another object of the present invention is to provide an improved fluid motor apparatus that is capable of operating at high efficiencies.

Another object of the present invention is to provide an improved fluid motor apparatus that is capable of operating at reduced noise levels.

Another object of the present invention is to provide an improved fluid motor apparatus that is completely self-lubricated throughout.

Another object of the present invention is to provide an improved fluid motor apparatus that requires minimal manufacturing costs, operating expenses and maintenance upkeep.

Other objects and advantages of the present invention will be evident from the following detailed description when read in conjunction with the accompanying drawings which illustrate the various embodiments of the invention.

BRIEF DESCRIPTION OF THE DRAWINGS

FIG. 3 is a cross sectional view of the barrel assembly of the fluid motor shown in FIG. 1.

FIG. 4 shows a cross sectional view of the fluid motor of FIG. 1 with the piston at its extreme right position and the valve spool at its extreme left position.

DESCRIPTION OF THE PREFERRED EMBODIMENT

Figure 1:
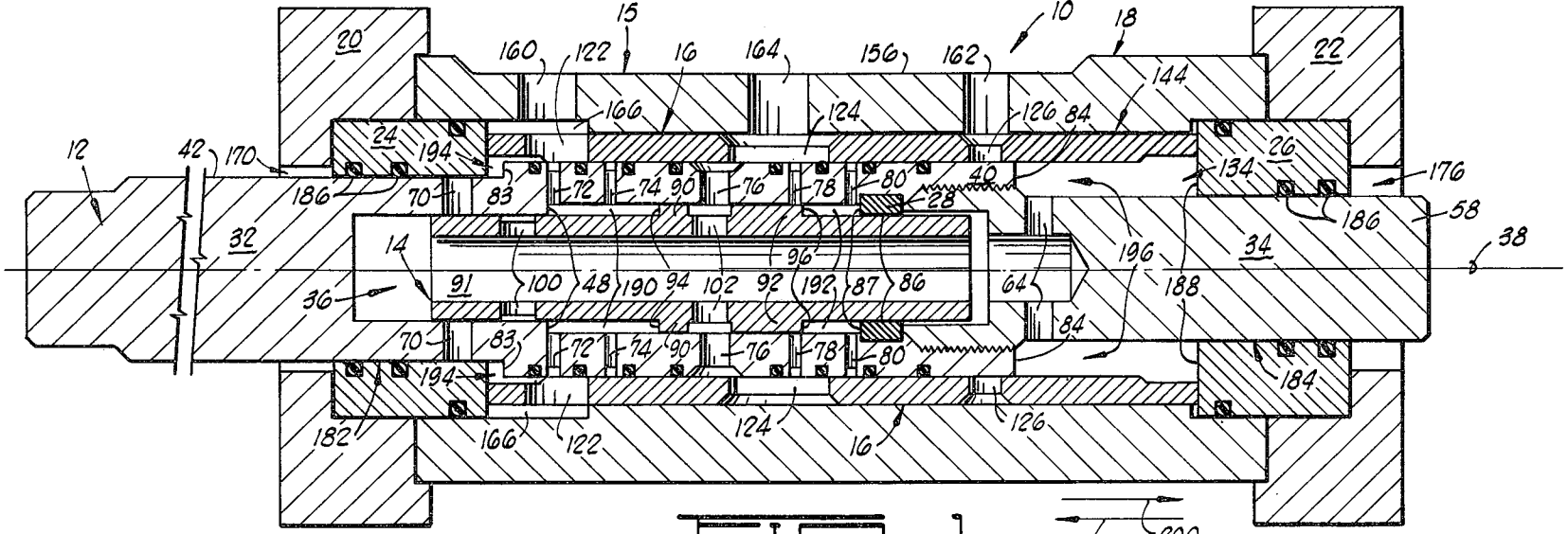
FIG. 1 is a cross sectional view of the fluid motor of the present invention showing the piston at its extreme left position, and the valve spool at its extreme right position.
Figure 2:
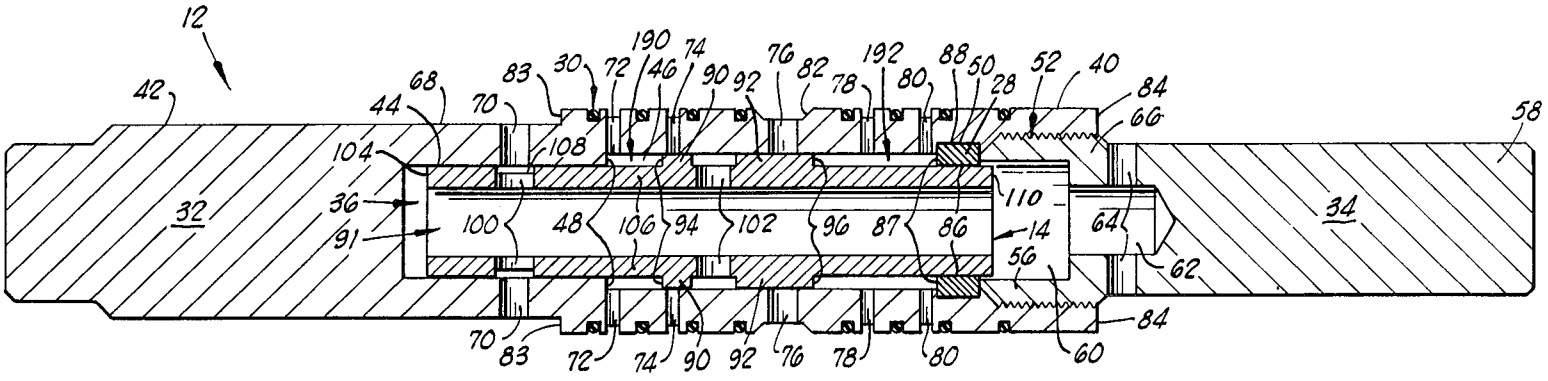
Figure 5:
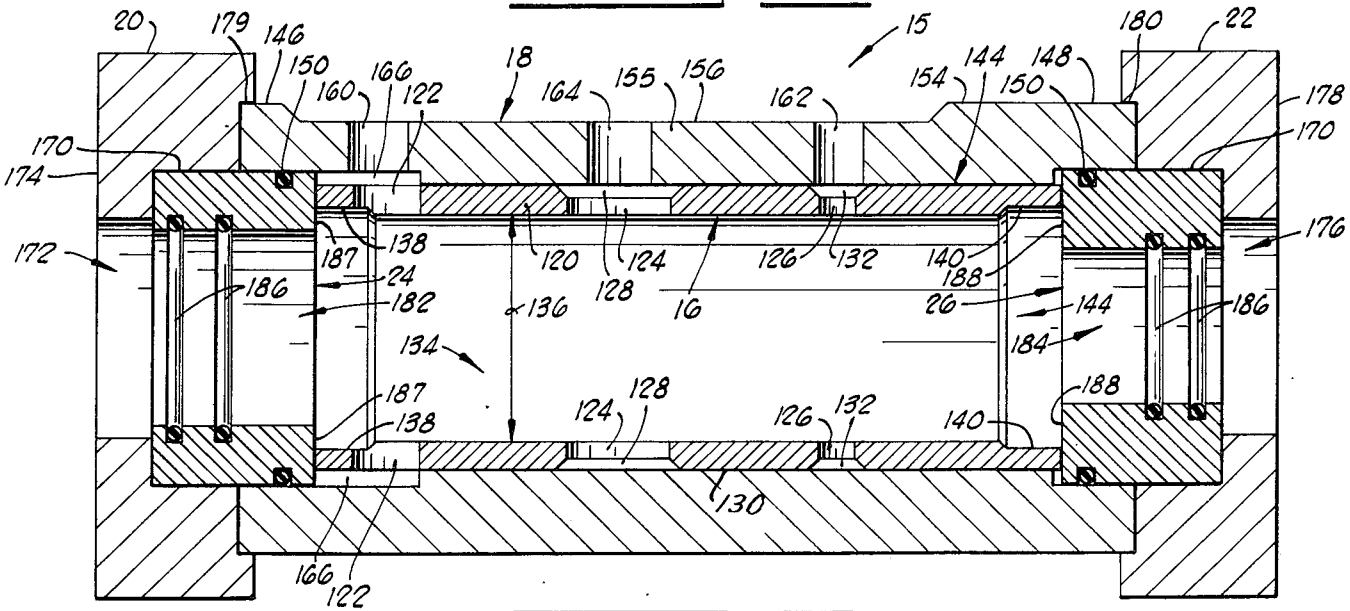

Referring to FIG. 1, shown therein is a fluid motor 10 constructed in accordance with the present invention, the view of FIGS. 1 through 4 being shown as longitudinal cross sectional views of fluid motor 10 and the components thereof, in order to disclose the working components of the fluid motor 10 in a manner that also depicts its operation.

The fluid motor 10 is comprised of only two moving parts, and as will become clear in the discussion to follow, these parts operate in a manner such that there is no physical impact made between the moving parts. As shown in FIG. 1, the fluid motor 10 is comprised of the piston 12 and the valve spool 14, which are the two moving components. Also, a barrel assembly 15 supports these moving components and comprises a cylinder sleeve 16; a cylinder barrel 18; a cylinder head 20; a cylinder head 22; a cylinder bearing 24; and a cylinder bearing 26. Also, a support ring 28 is located internally in the piston 12.

The views shown herein are views of moving components, and the components are shown in their extreme left or right positions during the reciprocating travel of the components. As will become clear below, during operation of fluid motor 10, piston 12 and valve spool 14 assume constantly changing positions relative to each other, the result of purposefully directed fluid flow pressures. Therefore, it will be understood that these components are constantly in motion during operation of the fluid motor 10, and that the comments relative to these components will be understood to be describing a dynamic system, while at the same time, referring to the two extreme positions as viewed in the accompanying drawings.

Figure 2:
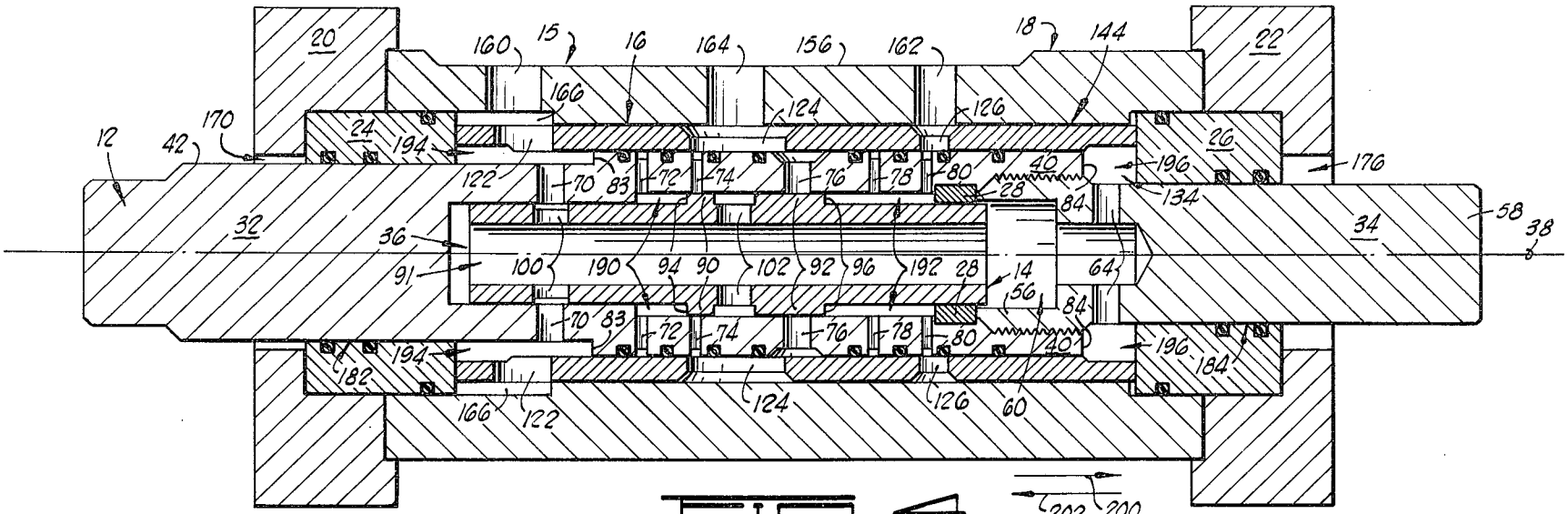
FIG. 2 is a cross sectional view of the piston and valve spool of the fluid motor shown in FIG. 1.

As viewed in FIG. 1, the piston 12 is an elongated member reciprocatingly supported by the bearings 24 and 26 and by the cylinder sleeve 16. Located along the outer surface, as shown in FIG. 2, are the spaced apart piston rings 30 that are conventional in design and retained as customary in appropriately placed ring grooves. The rings 30 serve to separate the fluid communication passageways along the piston 12 in the manner and for the reason that will become clear below.

FIG. 2 is a view of the piston 12 and valve spool 14, wherein the piston 12 may be seen to comprise the two parts 32 and 34 that are joined to form a reciprocating piston unit. The piston part 12 has an inner piston bore 36 concentric about the longitudinal axis 38 and extending inwardly from the end 40 of the piston part 32. The other end 42 of the piston part 32 is solid and may be used as a ram or other useful implement. The piston bore 36 comprises a first bore section 44 and a second bore section 46 having a larger internal diameter than the first bore section 44 such that there is formed a first piston shoulder face 48 therebetween. At the opposite end of the second bore section 46 to where the first piston shoulder face 48 is formed, there is an inner retaining groove 50 cut concentrically about axis 38. An internally threaded bore section 52 is located at the end 40 of the piston part 32.

The second part of the piston 12, the piston part 34, has an externally threaded portion 56 that is matingly receivable by the threaded bore section 52. The other end 58 of the piston part 34 (that is, the end opposite to the portion 56) is solid in construction in like manner to the end 42 of the piston part 32. Extending into the piston part 34 from the threaded portion end 56 and concentric to the axis 38 is a third bore section 60. Extending further into the piston part 34 is a fourth bore section 62, concentric to the axis 38 nd having a smaller internal diameter to that of the fourth bore section 60. The piston part 34 has a series of passages 64 that are evenly spaced, radially disposed apertures through the wall 66, these apertures establishing fluid communication to the fourth bore section 62.

Returning to the piston part 32, there are several radially spaced sets of apertures through the wall 68 thereof. The passages 70 establish fluid communication to the first bore section 44 of the piston bore 36. In like manner, passages 72, 74, 76, 78 and 80 establish fluid communication to the second bore section 46 through the wall 68 of the piston part 32. Each set of passages 72, 74, 76, 78 and 80 comprises radially disposed apertures positioned at predetermined intervals about the circumference of the piston part 32. The diameters of these passage apertures are determined as required to have a minimum pressure drop therethrough while achieving selectively directional fluid flow in the manner described below. An external groove 82 serves to connect the passages 76 along the outer surface of the wall 68, the edges of the groove 82 being tapered to provide transitional pressure changes as explained more particularly below. Also provided are grooves connecting the respective apertures of each of the sets of passages 72, 74, 78 and 80 as shown in FIG. 2.

The diameter of the piston part 32 is larger at the end 40 than at the end 42, and the first piston pressure face 83 is formed as a shoulder like step between these different sized portions of the piston part 32. The planar surface 84 of the end 40 of the piston part 32 serves as a second piston pressure face.

The support ring 28, provided to give sliding support to valve spool 14 in a manner to be described more fully below, is a generally donut shaped ring having a cylindrical internal surface 86, a flat radial surface 87, and a cylindrical external surface 88. The surface 87 serves as a shoulder surface in the same manner as the first shoulder face 48, and accordingly, the surface 87 will also be referred to as the second shoulder face 87. The dimensions of the support ring 28 are established so that the support ring 28 is pressingly received in and retained in the groove 50. The internal surface 86 is polished so as to provide sliding support contact with the valve spool 14.

The valve spool 14 is a cylindrical member with an internal bore 91 extending through the length thereof, and having a pair of raised ridges 90 and 92 extending about the outer surface of the spool. The ridge 90 has a first spool pressure face 94, and the ridge 92 has a second spool pressure face 96. Drilled in a predetermined spaced apart pattern about the valve spool 14 are the first spool passages 100 and the second spool passages 102, with the first spool passages 100 being near and a predetermined distance from the end 104 of the valve spool 14, and the second spool passages 102 being disposed between the ridges 90 and 92. Actually, the first spool passages 100 and the second spool passages 102 are sets of apertures radially located through the wall 106 of the valve spool 14, and the first spool passages 100 are joined by a groove 108 cut into wall 106 so as to provide fluid communication thereby to all of the aperture passages 100 from the outer surface of the valve spool. The dimension of the external diameter of the valve spool 14 at the ridges 90 and 92 is predetermined so that these ridges will serve as bearing surfaces slidably received in the second bore section 46 of the piston part 32. In like manner, the dimension of the end 104 is predetermined so as to be slidingly received in the first bore section 44 of the piston part 32, while the dimension of the end 110 of the valve spool 14 is predetermined so that this end is slidingly received and supported by the flat internal surface 86 of the support ring 28. In other words, with the support ring or bearing 28 pressed into place in the groove 50 as above discussed, the valve spool 14 is disposed so as to be slidingly retained by the first bore section 44, the second bore section 46 and the support ring 28 in the manner shown in FIG. 2.

The valve spool 14 is a machined and polished hollow cylinder that is slidingly disposed internally to the piston 12 in the inner piston bore 36. The above described first and second spool passageways 100 and 102 are sets of apertures spaced radially about the valve spool 14 for the purpose of providing selectively controlled fluid communication through the wall 106 of the valve spool 14. The purpose of having multiple apertures in each of the sets of the first and second spool passages 100 and 102 is to minimize the pressure drop of the fluid that flows through these passages and to have even pressure distribution about the valve spool 14.

As shown in FIG. 3, the cylinder sleeve 16 of the barrel assembly 15 is a hollow cylinder disposable in the bore of the cylinder barrel 18 which will be described in detail below. The outer diameter of the cylinder sleeve 16 is predetermined so as to be pressingly received in the bore of the cylinder barrel 18 in a manner that it is secured therein with a predetermined orientation. Located peripherally along the wall 120 of the cylinder sleeve 16 are the passageways or apertures 122, 124, and 126. Each of the passages 122, 124 and 126 actually comprises a series of slot shaped apertures formed about the diameter of the cylinder sleeve 16 at predetermined intervals thereabout. Additionally, there is an external groove 128 passing about the outer surface 130 of the cylinder sleeve 16 connecting all of the passages 124 such that fluid that is communicated thereto can flow simultaneously through all of the passages 124 in the manner and for the purpose described below. In like manner, an external groove 132 passes about the outer surface 130, thereby connecting all of the passages 126.

The cylinder sleeve 16 has piston support bore 134 that has a predetermined inner diameter at 136 that slidingly receives the piston 12 and against which the rings 30 press in conventional manner as was described hereinabove. The inner diameter of the cylinder sleeve 16 is increased in dimension over that of the diameter 136 at both ends 138 and 140 of the cylinder sleeve 16, for a purpose which will become clear below.

The cylinder barrel 18 of the barrel assembly 15 is an elongated, hollow cylinder having a longitudinal bore 144 sized to receive the cylinder sleeve 16 while cooperatively establishing the spatial relationship of the cylinder heads 20 and 22 and the bearings 24 and 26, which components will be described more fully below. The diameter of bore 144 at end 146 of cylinder barrel 18 is sized so as to pressingly receive a portion of the cylindrically shaped bearing 24. In like manner, the bore 144 is sized so as to pressingly receive a portion of the cylindrically shaped bearing 26 at the end 148 of the cylinder barrel 18. Conventional retaining grooves and rings 150 are provided about the outer surfaces of the bearings 24 and 26 so as to provide a fluid seal thereby. As shown in the FIG. 3, the diameter of the bore 144 along the major portion of the cylinder barrel 18 is predetermined to be a dimension such that the cylinder sleeve 16 can be pressed into the bore 144 and retained therein.

Along the outer surface 154 of the wall 155 and on one side of the cylinder barrel 18, a surface 156 is machined flat and inlet ports 160 and 162 are provided through the wall 155 of the cylinder barrel 18 thereat. Also provided is an outlet port 164 that extends through the wall 155. The ports 160, 162 and 164 are caused to align respectively with the passages 122, 126 and 124 of the cylinder sleeve 16. As shown in FIG. 3, the inner bore 144 of the cylinder barrel 18 has a greater internal diameter from the end 146 to a point near port 160 in a manner that provides clearance groove 166 to provide fluid communication from inlet port 160 to all of the passages 122 that are located through the cylinder sleeve 16. The inlet ports 160, 162 and the outlet port 164 are appropriately threaded for connecting a source of conduit pressure fluid to the inlet ports 160, 162 and to connect a fluid return line to the outlet port 164 in conventional fashion. While in the presently discussed preferred embodiment the inlet ports 160 and 162 are shown as two separate inlet ports, it will be understood that one inlet port could be utilized in conjunction with appropriate conduit means to provide fluid pressure distribution in the manner that is provided by the dual inlet ports 160 and 162.

Yet referring to FIG. 3, shown therein are the cylinder head members 20 and 22 that are disposed at the ends of the cylinder barrel 18. Each of the cylinder heads 20 and 22 is a block designed with cylindrically shaped depressions that fittingly receives one end of the cylinder barrel 18. Although not shown, the cylinder heads 20 and 22 are held in fixed spatial relationship by spanner bolts passing through appropriately placed bolt holes in the cylinder heads 20 and 22. The cylinder heads 20 and 22 also hold the bearings 24 and 26 that are positioned in spatial relationship to receive in internal bores therein the ends 42 and 58 respectively of the piston parts 32 and 34. Each of the cylinder heads 20 and 22 has a bore 170 that fittingly receives a portion of the cylindrically shaped bearings 24 and 26 as shown. The cylinder head 20 has a bore 172 that is concentric with the bore 170 and which extends from the surface 174 of the cylinder head to communicate with the larger bore 170; the smaller bore 172 is dimensioned to permit the end 42 of the piston part 32 to pass clearingly therethrough. In like manner, the cylinder head 22 has a bore 176 that extends from the surface 178 concentric to and in communication with the bore 170, the bore 176 being dimensioned so as to permit the end 58 of the piston part 34 to pass clearingly therethrough. Also, the cylinder heads 20 and 22 have formed therein the concentric grooves 179 and 180 respectively. The groove 179 is dimensioned to seatingly receive the end 146 of the cylinder barrel 18, and the groove 180 is dimensioned to seatingly receive the other end 148 of the cylinder barrel 18.

The bearings 24 and 26 are cylindrically shaped members having internal bores 182 and 184, respectively, that permit the piston parts 32 and 34 to slidingly and supportingly pass therethrough. As best viewed in FIG. 3, the bearing 24 is partially disposed in the bore 170 of the cylinder head 20 and abuts against the cylinder sleeve 16 at its end surface 187. In like manner, the cylinder bearing 26 is partially disposed in the bore 170 of the cylinder head 22 and abuts with the cylinder sleeve 16 at its end surface 188. The cylinder bearings 24 and 26 are outfitted with the sealing rings 186 in conventional manner as discussed above for the other sealing rings herein, the rings 186 serving the purpose of permitting free reciprocation of the piston 12 in the bearing 24 and 26, while preventing fluid leakage. The end surfaces 187 and 188, respectively of the bearings 24 and 26, serve a purpose which will be made clear below, and accordingly, the end surface 187 will hereinafter be referred to as the first barrel shoulder face 187 and the end surface 188 will hereinafter be referred to as the second barrel shoulder face 188.

Assembly of the components of the fluid motor 10 will be apparent from the above description. However for purposes of clarity, a brief discussion will now be given with reference to FIGS. 1 through 3. The valve spool 14 is first placed in the bore 36 of the piston part 32 such that the end 104 of the valve spool 14 is slidingly disposed in the first bore section 44. The support ring 28 is next placed over the other end 110 of the valve spool 14 and pressed into the groove 50 in the wall 68 of the piston part 32. Next, the threaded portion **5*b* of the piston part 34 is threadingly engaged in the threaded bore section 52 of piston part 32, thereby forming the unitary piston 12.**

The bearing 24 is placed in the bore 170 and the end 42 of the piston part 32 is placed so as to extend through the bore 182 of the bearing 24 and the bore 172 of the cylinder head 20. Of course, it will be recognized that all of the sealing rings 30, 150 and 186 must be placed in their respective grooves on the components prior to the assembly under discussion. The cylinder sleeve 16 is placed into the cylinder barrel 18 so that the ports and passages thereof are properly oriented in the manner described above, and these members are placed over the piston 12 so that the end 146 of the cylinder barrel 18 is seated in the groove 179 of the cylinder head 20, and so that the end 138 of the cylinder sleeve 16 abuts against the bearing 24. The bearing 26 is placed over the end 58 of the piston part 34 and the cylinder head 22 is placed in position such that end 148 of the cylinder barrel 18 is seated in the groove 180 and the end 140 of the cylinder sleeve 16 abuts against the bearing 26. The spanner bolts, discussed above but not shown in the figures, are assembled in conventional manner through the appropriately placed holes in the cylinder heads 20 and 22 and tightened so as to fixedly position the assembled components.

The fluid motor 10, assembled as described above and viewed in FIGS. 1 and 4, has a first spool actuating member 190 that is provided by the space bounded by the first spool pressure face 94, the valve spool 14, the first piston shoulder face 48 of the piston part 32 and the second bore section 46 of the piston part 32. A second spool actuating chamber 192 is provided by the space bounded by the second spool pressure face 96, the valve spool 14, the second bore section 46 of the piston part 32 and the second piston shoulder face 87 of the support ring 28.

A first piston actuating chamber 194 is provided by the space bounded by the end 42 of the piston part 32, the first piston pressure face 83, the first barrel shoulder face 187 of the cylinder bearing 24, and the end 138 of the cylinder sleeve 16. As will become clear below, the enlargement of the bore 134 at the end 138 of the cylinder sleeve 16 provides fluid communication from the inlet port 160 and the passage 122 so that fluid pressure is exerted in the first piston actuating chamber 194 at all times and independent to the position of the piston 12.

A second piston actuating chamber 196 is provided by the space bounded by the end 58 of the piston part 34, the second piston pressure face 84, the second barrel shoulder face 188 of the cylinder bearing 26, and the end 140 of the cylinder sleeve 16. As will become clear, the second piston actuating chamber 196 is alternately pressurized and relieved as controlled by the cooperative action of the piston 12 and the valve spool 14 as these components align with or block the fluid communication passages in a manner to be described in detail below.

A source of high pressure fluid is connected to the inlet ports 160 and 162, and a fluid reservoir is connected to the outlet port 164. Although not essential for the operation of the present invention, it is advisable to provide check valves in the conduits that are connected to the inlet ports 160 and 162 for a purpose that will become clear below.

The operation of the fluid motor 10 will now be described with reference to all of the figures, but particularly as illustrated by FIGS. 1 and 4. FIG. 1 is a cross sectional view of the fluid motor 10 of the present invention showing the piston 12 at its extreme left position, and the valve spool 14 at its extreme right position (relative to the viewer). FIG. 4 shows a cross sectional view of the fluid motor 10 with the piston 12 at its extreme right position and the valve spool 14 at its extreme left position. Arbitrarily for discussion purposes, the piston 12 and the valve spool 14 may hereinafter be referred to as being positioned in a first positional mode when assuming the position depicted by FIG. 4, and the piston 12 and the valve spool 14 may hereinafter be referred to as being positioned in a second positional mode when assuming the position depicted by FIG. 1.

In FIG. 1, the inlet port 160 has fluid communication with the groove 166, the passages 122, the first piston actuating chamber 194, the passages 72, and the first spool actuating chamber 190. The inlet port 162 has fluid communication with the passages 126, the passages 126 being blocked by the end 40 of the piston part 32. The outlet port 164, in FIG. 1, has fluid communication with the passages 124, the passages 76, the passages 102, the bore 36 and the passages 78 (the latter blocked by the valve spool 14).

Turning now to FIG. 4, which is a view showing the fluid motor 10 with the valve spool 14 and the piston 12 having assumed different positions to that shown in FIG. 1, the inlet port 160 has fluid communication with the groove 166, the passages 122, the first piston actuating chamber 194, the passages 70, the first spool passages 100 and the bore 36. The inlet port 162 has fluid communication with the passages 126, the passages 80 and the second actuating chamber 192. The outlet port 164 has fluid communication with the passages 124, the passages 74 (now shown blocked by the valve spool 14) and the passages 76 (now shown blocked by the valve spool 14).

While this is not a complete description of fluid communication for all of the ports and passages of the fluid motor 10, it should be helpful in following the discussion of the operation of the fluid motor, and further details of fluid communication within the fluid motor 10 will become clear as the discussion progresses. For clarity of description, the directions right and left will be used in the following discussion as follows: the direction right will refer to the direction of arrow 200, also referred to as the first direction, and the direction left will refer to the direction of the arrow 202, also referred to as the second direction.

Referring to FIG. 1, shown therein is the fluid motor 10 with the piston 12 having completed its stroke to the left. At this point, pressure fluid from an external hydraulic source coming into the port 160 has flowed through the passages 72 (via the fluid communication linkage above-described) into the first spool actuating chamber 190 thereby forcing the valve spool 14 to the right and expelling oil in the second spool actuating chamber 192 through the passages 78 into the passages 124, the groove 128 and out the outlet port 164 which is connected to a receiving reservoir. When the second spool pressure face 96 on the valve spool 14 reached a point that blocked flow out of the second spool actuating chamber 192 into the passages 78 (as having just occurred as shown in FIG. 1), the pressure in the second spool actuating chamber 192 equalized with fluid pressure introduced into the first spool actuating chamber 190, thereby causing the valve spool 14 to stop its movement to the right. Thus, the motion of the spool 12 to the right is stopped by the conversion of the second spool actuating chamber 192 into a trapped fluid chamber so that no contact between the second spool pressure face 96 and the second shoulder face 87 can occur. That is, the trapped fluid chamber 192 serves as a means for braking the valve spool 14 so that there is no mechanical impact between the valve spool 14 and the piston 12. When the valve spool 14 has shifted to the position shown in FIG. 1, the second piston actuating chamber 196 is opened to the outlet port 164 through the passages 64 and 36 in the piston 12, through the second spool passages 102 in the valve spool 14 now open to the passages 76 in the piston 12, and the apertures 124 in the cylinder sleeve 16. Pressure fluid entering the inlet port 160 now acts on the first piston pressure face 83, forcing the piston 12 to move to the right, and this in turn forces pressure fluid in the second piston actuating chamber 196 to exit through the outlet port 164 as described.

Referring now to FIG. 4, this view shows the fluid motor 10 with the piston 12 having completed its stroke to the right. At this point, pressure fluid coming into the inlet port 162 enters the second spool actuating chamber 192 through the passages 80, the passages 80 now being aligned with the inlet port 162 via the apertures 126 by the repositioning of piston 12. The pressure fluid entering the second spool actuating chamber 192 applies force against the second pressure face 96 forcing the valve spool 14 to the left whereupon pressure fluid in the first spool actuating chamber 190 is expelled through the passage 74 into the apertures 124, and out through the outlet port 164. (FIG. 1 shows the ridge 90 of the valve spool 14 blocking the passages 74, and it must be remembered that the description now given is that of the fluid motor 10 in dynamic motion while the views given are of necessity limited to static views). When the ridge 90 on the valve spool 14 has reached a point wherein flow of pressure fluid leaving the first spool actuating chamber 190 is blocked, the pressure in the first spool actuating chamber 190 equalizes with pressure entering the second spool actuating chamber 192, at which point the valve spool 14 stops its movement to the left. Thus, the motion of the spool 12 to the left is stopped by the conversion of the first spool actuating chamber 190 into a trapped fluid chamber so that no physical contact between the first spool pressure face 94 and the first piston shoulder face 48 can occur. That is, the trapped fluid chamber 190 serves as a means for braking the valve spool 14 so that there is no mechanical impact between the valve spool 14 and the piston 12. When valve spool 14 has shifted to the left as shown in FIG. 4, the second piston actuating chamber 196 is opened to inlet pressure fluid entering the inlet port 160 via the apertures 122, the passages 70, the first spool passages 100, the piston bore 36 and the passages 64 in the piston 12. As indicated by the structure depicted in FIGS. 1 and 4, the area of the second piston pressure face 84 is larger than the area of the first piston pressure face 83, thereby presenting a greater surface area at the second piston pressure face 84 than at the first piston pressure face 83. Consequently, a greater amount of total force is exerted on the second piston pressure face 84 because of the differential area of the two piston pressure faces 83 and 84, when both the first piston pressure face 83 and the second piston pressure face 84 are simultaneously acted upon by the fluid inlet pressure fluid. Therefore, the piston 12 is forced to travel to the left due to the difference in total force exerted by the pressure fluid on the piston in the direction 202. Pressure fluid is displaced by the first piston pressure face 83 from the first piston actuating chamber 194 through the passages 70 and the first spool passages 100 to flow to the second piston actuating chamber 196 in order to maintain this force difference.

Pressure fluid is trapped in the first and second spool actuating chambers 190 and 192 such that the valve spool 14 never impacts physically with the first piston shoulder face 48 or the second piston shoulder face 87 of the support ring 28 during the shifting movement of the valve spool 14. This makes it possible to shift valve spool 14 at very high cycling rates without experiencing any mechanical deterioration of the valve spool 14 or other components of the fluid motor 10. If the piston 12 should attempt to travel further to the right than shown in FIG. 4, the passages 76 therein are blocked from fluid communication with the aperture 124 by the ridge 92, thus trapping pressure fluid in the second piston actuating chamber 196 until the valve spool 14 has shifted as shown. If piston 12 should attempt to travel further to the left than shown in FIG. 1, the pressure fluid flow through the passages 70 is blocked by the cylinder bearing 24, thereby stopping the flow of fluid to the second piston actuating chamber 196, and trapping fluid in the first piston actuating chamber 194, thereby making the differential area advantage of the second piston pressure face 84 ineffective. These valving arrangements then cause the valve spool 14 to shift as described.

To protect the fluid motor 10 from a mechanical force great enough to overcome the force of the inlet pressure fluid such that mechanical overtravel of the piston might be possible, a conventional check valve on the pressure inlet lines leading to the inlet ports 160 and 162 will, in conjunction with the trapped pressure fluid as described, always insure that the piston 12 does not make contact at its first or second piston pressure face 83 or 84 at any time during the operation of the fluid motor 10.

Thus, it is apparent that the above-described fluid motor is capable of achieving the stated objects and possesses very large potential in its field of operation. The fluid motor features very short flow passages and large area flow passages as described. These allow the unit to handle a very large volume of pressure fluid as minimal pressure drop is encountered even at very high rates of reciprocation. There is no mechanical contact on either the piston stroke or on the valve spool shift, allowing the unit to be cycled at high rates of reciprocation without fatigue of its components or mechanical damage that could be caused by continual mechanical pounding. Noise is significantly reduced from prior art units due to the elimination of any mechanical impact and reduced fluid exhaust noise.

In the preferred embodiment, as illustrated herein for purposes of the disclosure of the invention, all of the components have been shown as being round, allowing the unit to be completely balanced and lubricated by oil film on all the moving surfaces. The unit uses large piston rods in relation to the differential piston area, allowing the use of large bearing areas leading to the reduction of external side load damage to bearings, the piston and the sealing rings. Of course, it will be recognized that the piston areas can be varied to allow the force and speed to be greater in one direction of travel. This feature may be of design importance as it allows the fluid motor 10 to be matched to the work being performed.

The fluid motor of the present invention features large valve spool porting with small shifting area, providing rapid valve spool shift and large flow passages without the use of reduced diameter shifting pins. The flow cutoff passages can be sharp cornered for harsh reversal, or the shoulders can be tapered to give smooth decelerated reversal, allowing the output motion to be tailored to the performance required of the unit.

Of course, the fluid motor of the present invention can be manufactured having various stroke lengths. All that is required for this is the changing of the distances between the various ports and flow passages to achieve any length of stroke required within limits of manufacturing capability. And in the same manner, the fluid motor of the present invention can be manufactured to feature various force outputs by properly designing and machining the unit to size. Fluid motors are envisioned that are very small in size ranging upward to where a fluid motor would achieve millions of pounds of output force.

Although the fluid motor of the present invention can be operated at very high speeds of reciprocation, it can also be operated at very slow rates of reciprocation merely by reducing oil flow to the unit.

The fluid motor of the present invention, having only two moving parts, presents a very reliable and serviceable unit. Not only is the fluid motor a highly efficient unit upon initial manufacture, this efficiency is maintained over a very long unit life.

Numerous applications are envisioned for the fluid motor power unit of the present invention, including but not limited to the following: vibrators; bin shakers; compactors; post drivers; pile drivers; form pin drivers; chipping hammers; pavement breakers (both handheld and tractor mounted units); rock drills; vibratory plows; well drilling; power sources for piston or plunger pumps and boosters; impact and vibrator pile extractors; and vibratory rippers. Applications are envisioned in metal working machinery and in a large number of applications in which reciprocating motion or vibration is required.

It will be apparent from the foregoing, to those skilled in the art, that the apparatus described in detail above achieves a more efficient, simpler and more effective fluid motor apparatus, capable of achieving the above-enumerated objects while offering many features and advantages in advance to the art of fluid motors. Changes may be made in the construction and the arrangement of the parts or the elements of the embodiment that has been described herein without departing from the spirit and scope of the invention as defined in the following claims.

What is claimed is:

1. A pressure fluid operated motor comprising:

a barrel assembly having a piston support bore, an inlet port means, and an outlet port means;

a piston, having a piston bore disposed therein, supported by the barrel assembly in the piston support bore, the piston movable alternately in a first direction and in a second direction, and the piston having a first piston pressure face and a second piston pressure face larger than the first piston pressure face, the first piston pressure face forming with the barrel assembly a first piston actuating chamber having continuous fluid communication with the inlet port means, and the second piston pressure face forming with the barrel assembly a second piston actuating chamber; and, valve spool means supported by the piston for selectively communicating inlet pressure fluid from the inlet port means to the second piston actuating chamber, the valve spool means characterized as comprising a trapped fluid means for preventing mechanical impact between the valve spool means and the piston and the valve spool means further characterized as comprising a valve spool disposed in the piston bore for movement therein the valve spool having a first positional mode wherein the valve spool has moved maximally in the second direction in relation to the piston, and the valve spool having a second positional mode wherein the valve spool has moved maximally in the first direction in relation to the piston, and the trapped fluid means characterized as comprising:

a first spool pressure face portion of the valve spool forming with the piston a first spool actuating chamber, the first spool actuating chamber forming a trapped fluid chamber when the valve spool is in the first positional mode;

a second spool pressure face portion of the valve spool forming with the piston a second spool actuating chamber, the second spool actuating chamber forming a trapped fluid chamber when the valve spool is in the second positional mode;

passage means for selectively providing fluid communication between the first spool actuating chamber and the inlet port means, and between the first spool actuating chamber and the outlet port means; and, passage means for selectively providing fluid communication between the second spool actuating chamber and the inlet port means, and between the second spool actuating chamber and the outlet port means.

2. The pressure fluid operated motor apparatus of claim 1 wherein:

the passage means for selectively providing fluid communication between the first spool actuating chamber and the inlet and outlet port means comprises spaced apart passages communicating with the first spool actuating chamber and disposed in the piston, the spaced apart passages positioned by the relative position of the piston and the valve spool to alternately align with the inlet port means and the outlet port means; and, the passage means for selectively providing fluid communication between the second spool actuating chamber and the inlet and outlet port means comprises spaced apart passages communicating with the second spool actuating chamber and disposed in the piston, the spaced apart passages positioned by the relative position of the piston and the valve spool to alternately align with the inlet port means and the outlet port means.

3. A pressure fluid operated motor apparatus comprising:

a barrel assembly having a piston support bore, an inlet port mans and an outlet port means;

a piston movably disposed in the piston support bore, the piston having a piston bore, and the piston comprising:

a first piston pressure face forming with the barrel assembly a first piston actuating chamber, the first piston actuating chamber having continuous fluid communication with the inlet port means; and, a second piston pressure face forming with the barrel assembly a second piston actuating chamber, the second piston pressure face being larger than the first piston pressure face; and, a valve spool means for alternately providing fluid communication between the second piston actuating chamber and the inlet port means, and between the second piston actuating chamber and the outlet port means, the valve spool means comprising a valve spool supported by the piston and disposed in the piston bore for movement therein and further comprising a valve spool braking means for preventing mechanical impact between the valve spool and the piston, the valve spool characterized as comprising:

a first spool pressure face;

a second spool pressure face, the valve spool braking means characterized as comprising a first spool actuating chamber formed by the first spool pressure face and the piston, and as comprising a second spool actuating chamber formed by the second spool pressure face and the piston;

passage means for selectively providing fluid communication between the first spool actuating chamber and the inlet port means, and between the first spool actuating chamber and the outlet port means; and, passage means for selectively providing fluid communication between the second spool actuating chamber and the inlet port means, and between the second spool actuating chamber and the outlet port means.

4. The pressure fluid operated motor apparatus of claim 3 wherein:

the passage means for selectively providing fluid communication between the first spool actuating chamber and the inlet and outlet port means comprises spaced apart passages communicating with the first spool actuating chamber and disposed in the piston, the spaced apart passages positioned by the relative position of the piston and the valve spool to alternately align with the inlet port means and the outlet port means; and, the passage means for selectively providing fluid communication between the second spool actuating chamber and the inlet and outlet port means comprises spaced apart passages communicating with the second spool actuating chamber and disposed in the piston, the spaced apart passages positioned by the relative position of the piston and the valve spool to alternately align with the inlet port means and the outlet port means.

5. A pressure fluid operated motor apparatus comprising:

a barrel assembly having a first cylinder bearing and a second cylinder bearing in spaced apart relationship;

a piston having a first end supported by the first cylinder bearing, a second end supported by the second cylinder bearing and a longitudinal piston bore, the piston being movably retained by said first and second bearings between a first positional mode and a second positional mode, the piston forming with the barrel assembly a first piston actuating chamber, the piston having a first piston pressure face portion disposed adjacent the first piston actuating chamber whereby fluid pressure communicated to the first piston actuating chamber exerts force on the piston pressure face, and a second piston actuating chamber, the piston having a second piston pressure face portion larger than the first piston pressure face portion, the second piston pressure face disposed adjacent to the second piston actuating chamber whereby fluid pressure communicated to the second piston actuating chamber exerts force on the second piston pressure face, such that fluid pressure communicated to the first piston actuating chamber will move the piston to the first mode and whereby fluid pressure communicated to the first piston actuating chamber and to the second piston actuating chamber will move the piston to the second positional mode;

means for continuously communicating fluidic pressure to the first piston actuating chamber and alternately communicating fluidic pressure to the first piston actuating chamber and to the second piston actuating chamber, and means for communicating fluidic pressure characterized as comprising a valve spool, reciprocatingly supported by the piston and disposed for movement in the piston bore, the means for providing fluidic pressure characterized as comprising means for communicating continuous fluidic pressure to the first piston actuating chamber and means for alternately communicating fluidic pressure to the second piston actuating chamber and releasing the fluidic pressure to the second piston actuating chamber, the means being responsive to the relative position of the piston and the valve spool, and the means for communicating fluidic pressure further comprising means for braking the valve spool to prevent mechanical impact between the piston and the valve spool, the valve spool being actuated by fluid pressure directed in response to the relative position of the piston and the valve spool, and the valve spool forming with the piston a first spool actuating chamber and a second spool actuating chamber, the valve spool being movable to be positioned in a first positional mode and being movable to be positioned in a second positional mode, the valve spool being moved to the first positional mode when fluidic pressure is communicated to the second spool actuating chamber and being moved to the second positional mode when fluidic pressure is communicated to the first spool actuating chamber, and means for braking the valve spool comprising a first trapped fluid chamber formed by the first spool actuating chamber when the valve spool is in the first positional mode, and formed by the second spool actuating chamber when the valve spool is in the second positional mode;

passage means for communicating fluidic pressure to the first spool actuating chamber while releasing fluid pressure in the second spool actuating chamber whereby the valve spool is moved to the second positional mode, and alternately for communicating fluidic pressure to the second spool actuating chamber while releasing fluid pressure in the first spool actuating chamber whereby the valve spool is moved to the first positional mode; and, passage means for communicating fluidic pressure to the second piston actuating chamber when the valve spool is positioned in the first positional mode of the valve spool, and for releasing fluidic pressure in the second piston actuating chamber when the valve spool is positioned in the second positional mode of the valve spool.

6. The pressure fluid operated motor apparatus of claim 5 wherein the barrel assembly has a fluid inlet port means and a fluid outlet port means, and the means for alternately communicating and releasing fluidic pressure to the first and second spool actuating chambers is characterized as comprising:

the piston has at least one passage having fluidic communication with the first spool actuating chamber and which is in fluidic communication with the outlet port mans when the piston is positioned in the first positional mode of the piston, and at least one passage having fluidic communication with the inlet port means when the piston is positioned in the second positional mode of the piston; and, the piston has at least one passage having fluidic communication with the second spool actuating chamber and which is in fluidic communication with the inlet port means when the piston is positioned in the first positional mode of the piston, and at least one passage having fluidic communication with the outlet port means when the piston is positioned in the second positional mode of the piston.

7. The pressure fluid operated motor apparatus of claim 6 wherein:

the piston has a fluid entering passage and a fluid releasing passage, the fluid entering passage and the fluid releasing passage having fluid communication with the piston bore, and the piston has a fluid directing passage having fluid communication with the second piston actuating chamber and the piston bore;

the valve spool has a first spool passage and a second spool passage, the first and second spool passages having fluidic communication with the piston bore; and, wherein the passage means for communicating and releasing fluidic pressure to the second piston actuating chamber includes the fluid entering passage, the fluid releasing passage, and the fluid directing passage disposed in the piston, and the first spool passage and the second spool passage disposed in the valve spool, and wherein:

the fluid entering passage is in fluidic communication with the inlet port means of the barrel assembly when the piston is positioned in the first positional mode of the piston, the fluid entering passage being blocked from being in fluidic communication with the inlet port means when the piston is positioned in the second positional mode of the piston;

the fluid releasing passage is in fluidic communication with the outlet port means of the barrel assembly;

the first spool passage is in fluidic communication with the fluid entering passage when the piston is positioned in the first positional mode and the valve spool is positioned in the first positional mode of the valve spool; and the second spool passage is in fluidic communication with the fluid releasing passage of the piston when the valve spool is positioned in the second positional mode of the valve spool.

8. A pressure fluid operated motor apparatus comprising:

a barrel assembly having an elongated piston support bore, an inlet port means and an outlet port means;

a piston having a piston bore and supported by the barrel assembly, the piston supported in the piston support bore for movement alternately in a first direction and in a second direction, the piston having a first mode wherein the piston has moved maximally in the first direction, and the piston having a second mode wherein the piston has moved maximally in the second direction, the piston comprising:

a first piston pressure face forming with the barrel assembly a first piston actuating chamber, the first piston actuating chamber having continuous fluid communication with the inlet port means; and, a second piston pressure face forming with the barrel assembly a second piston actuating chamber, the second piston pressure face being larger than the first piston pressure face;

a valve spool disposed in the piston bore for movement therein alternately in the first direction and in the second direction, the valve spool having a first positional mode wherein the valve spool has moved maximally in the second direction in relation to the piston, and the valve having a second positional mode wherein the valve spool has moved maximally in the first direction in relation to the piston, the valve spool comprising:

a first spool pressure face forming with the piston a first spool actuating chamber, the first spool actuating chamber forming a trapped fluid chamber when the valve spool is in the first positional mode;

a second spool pressure face forming with the piston a second spool actuating chamber, the second spool actuating chamber forming a trapped fluid chamber when the valve spool is in the second positional mode;

first passage means disposed in the piston for providing fluid communication between the first spool actuating chamber and the outlet port means when the valve spool is moved toward the first positional mode, and for providing fluid communication between the first spool actuating chamber and the inlet port means when the valve spool is moved toward the second positional mode;

second passage means disposed in the piston for providing fluid communication between the second spool actuating chamber and the outlet port means when the valve spool is moved toward the second positional mode, and for providing fluid communication between the second spool actuating chamber and the inlet port means when the valve spool is moved toward the second positional mode; and, passage means disposed in the valve spool and in the piston for providing fluid communication between the second piston actuating chamber and the inlet port means to move the piston to the second mode when the valve spool is in the first positional mode, and for providing fluid communication between the second piston actuating chamber and the outlet port means to move the piston to the first mode when the valve spool is in the second positional mode.

* * * * *